US006669383B2

(12) United States Patent
Ansell et al.

(10) Patent No.: US 6,669,383 B2
(45) Date of Patent: Dec. 30, 2003

(54) PRINTING APPARATUS AND PRINTING METHOD WITH MOVABLE PRINTING-HEAD GUIDE

(75) Inventors: Iain Ansell, Newmarket Suffolk (GB); Steven Roland Brace, Cambridgeshire (GB)

(73) Assignee: Francotyp-Postalia AG & Co., Birkenwerder (DE)

( * ) Notice: Subject to any disclaimer, the term of this patent is extended or adjusted under 35 U.S.C. 154(b) by 76 days.

(21) Appl. No.: 09/793,349

(22) Filed: Feb. 26, 2001

(65) Prior Publication Data

US 2001/0038765 A1 Nov. 8, 2001

(30) Foreign Application Priority Data

Feb. 24, 2000 (DE) ..... 100 09 802

(51) Int. Cl.[7] ..... B41J 2/165

(52) U.S. Cl. ..... 400/283; 400/355; 400/76; 347/37; 101/71

(58) Field of Search ..... 400/76, 23, 320, 400/283, 352, 354, 355, 59, 319; 347/9, 37; 101/371, 71

(56) References Cited

U.S. PATENT DOCUMENTS

| | | | | |
|---|---|---|---|---|
| 2,651,400 A | * | 9/1953 | Young et al. | 197/2 |
| 3,583,540 A | * | 6/1971 | Bernard | 346/134 |
| 4,545,695 A | | 10/1985 | Agata | |
| 4,774,529 A | | 9/1988 | Paranjpe et al. | |
| 4,930,911 A | * | 6/1990 | Sampson et al. | 101/27 |
| 5,039,233 A | | 8/1991 | Baitz et al. | |
| 5,947,614 A | | 9/1999 | Shoji et al. | |
| 6,099,107 A | * | 8/2000 | Ford et al. | 347/104 |
| 6,447,183 B2 | * | 9/2002 | Ford | 400/320 |
| 2002/0001496 A1 | * | 1/2002 | Ford | 400/76 |

FOREIGN PATENT DOCUMENTS

| | | |
|---|---|---|
| DE | 31 25 426 A1 | 1/1983 |
| DE | 88 14 238 U1 | 5/1990 |
| DE | 198 22 423 A1 | 11/1999 |
| EP | 0 933 210 A2 | 8/1999 |
| EP | 0 980 761 A1 | 2/2000 |
| EP | 0 980 762 A2 | 2/2000 |

* cited by examiner

*Primary Examiner*—Ren Yan
*Assistant Examiner*—Kevin D. Williams
(74) *Attorney, Agent, or Firm*—Laurence A. Greenberg; Werner H. Stemer; Ralph E. Locher

(57) ABSTRACT

A printing apparatus, particularly, a franking machine, with a movable printing-head guide includes a base, a guide connected to the base, a printing head, and an offsetting device. The guide moves the head, during printing, between first and second longitudinal positions in a given direction with respect to the base to effect a relative movement between the head and a print medium. The offsetting device prints images offset to one another transverse to the given direction and overlapping one another at most in an edge region of the images. The offsetting device is connected to the head and offsets the head relative to the base from a first transverse position into at least one second transverse position spaced from the first transverse position in a direction transverse to the given direction. The offsetting device is connected to the guide. A corresponding printing method, particularly, a franking impression is also provided.

20 Claims, 5 Drawing Sheets

PRINTING APPARATUS AND PRINTING METHOD WITH MOVABLE PRINTING-HEAD GUIDE

BACKGROUND OF THE INVENTION

Field of the Invention

The invention lies in the field of printing. The invention relates to an apparatus for printing, in particular, a franking and/or addressing machine. The printing apparatus has a printing head constructed for achieving the relative movement between the printing head and the medium to be printed to be capable, during printing, of being moved between a first longitudinal position and a second longitudinal position in a given direction with respect to a base element. The printing head is at the same time guided by a first guide device. An offsetting device allowing the printing of printing images offset to one another transverse to the given direction and overlapping one another at most in an edge region is also provided. The offsetting device is constructed for offsetting the printing head relative to the base element from a first transverse position into at least one second transverse position spaced from the first transverse position transverse to the given direction. The present invention relates, furthermore, to a method for printing.

Within the meaning of the invention, the term "printing head" designates all types of printing devices that can generate a printing image on a medium. In other words, the term, on one hand, includes printing devices employing any desired printing techniques. Nor is the term restricted to the component that directly generates the printing image, but may additionally embrace further components required for generating the printing image. Such components may include, for example, ink reservoirs, etc.

A generic printing apparatus and a generic method for printing are disclose, for example, from European Patent Application EP 0 933 210 A2. In the apparatus described there, the printing head is disposed displaceably in a mounting guided by a guide rod. In order to print, the mounting, and, therefore, the printing head, is moved in a first direction, to be precise parallel to the guide rod.

When a first printing image has been generated, the printing head is offset relative to the mounting perpendicularly to the first direction in order to generate, in a further step, a second printing image with the printing head being moved in a direction opposite the first direction. The offset of the second printing image to the first printing image is of a size such that the two printing images overlap at most in an edge region in which they are contiguous to one another transverse to the first direction. It is thereby possible, by using such a printing head, to generate an entire printing image, of which the dimension transverse to the first direction, that is to say transverse to the printing direction, corresponds approximate to double the printing width of the printing head.

In the prior art apparatus, the offsetting device is disposed on the mounting and is constructed as a linear drive that acts on the printing head.

The configuration, on one hand, has a disadvantage that, during printing, a relatively high mass has to be moved using the additional linear drive on the mounting. Such movement has an adverse effect on the vibrational behavior of the drive and, therefore, on the printing image and/or on the outlay necessary for compensating the disadvantage. Additionally, limits are placed on the accelerations that can be achieved. Thus, there is a corresponding limitation on the printing speed.

Another disadvantage lies in the complicated configuration of the mounting. The mounting, while having as low a mass as possible, and, therefore, as small a construction volume as possible, must make a transverse guide available for the printing head. When exchangeable printing heads, such as, for example, ink-jet cartridges, are used, in order to avoid an excessively complicated exchange of the printing head or to make it possible to use a standard printing head, the heads must sometimes be produced in two parts with a separate receptacle, driven by the linear drive, for the printing head.

SUMMARY OF THE INVENTION

It is accordingly an object of the invention to provide a printing apparatus and a printing method with a movable printing-head guide that overcome the hereinafore-mentioned disadvantages of the heretofore-known devices and methods of this general type and that make it possible to carry out rapid and high-quality printing with a low outlay.

With the foregoing and other objects in view there is provided, in accordance with the invention, a an apparatus for printing, particularly, a franking machine, including a base element, a guide device moveably connected to the base element, a printing head, the guide device moving the printing head, during printing, between a first longitudinal position and a second longitudinal position in a given direction with respect to the base element to effect a relative movement between the printing head and a medium to be printed, and an offsetting device for printing images offset to one another transverse to the given direction and overlapping one another at most in an edge region of the images, the offsetting device connected to the printing head and offsetting the printing head relative to the base element from a first transverse position into at least one second transverse position spaced from the first transverse position in a direction transverse to the given direction, and the offsetting device connected to the guide device for offsetting the guide device.

The invention is based on the technical teaching that a high-quality print is achieved at relatively low outlay when using a generic apparatus when the offsetting device is constructed for offsetting the first guide device.

By virtue of the refinement according to the invention, during printing, only the printing head is to be moved, in particular, to be accelerated. Because the mass to be moved is, in such a case, lower than the prior art apparatus, the tendency of the system, including the printing head and its drive, to vibrate is reduced. Thus, higher accelerations can be achieved, which leads to a quicker printing operation. Additionally, the configuration reduces the outlay for any damping measures.

Moreover, only a simple standard mounting has to be provided for the printing head, insofar as it is made exchangeable, because the latter does not have to be moved relative to the mounting. Such a configuration further reduces the mass to be moved and the outlay involved in producing the apparatus.

In accordance with another feature of the invention, the offsetting device is constructed such that the offset for the first guide device takes place essentially in one plane. Such a configuration is advantageous in view of the printing operation because there is no resulting change, during the offsetting of the printing head, in spacing from the medium to be printed, which, where appropriate, would have to be compensated. Moreover, the necessary construction space for the apparatus then remains small because space does not have to be kept free for a projecting offsetting movement transverse to the actual offset direction.

The movement of the guide device during offsetting may take any desired form, and, in particular, it may follow any desired path curve. Preferably, the offsetting device is constructed for the parallel offsetting of the first guide device, in other words, in substantially mutually parallel positions. In such a case, by virtue of the simple movement sequence, it is possible for the guide device, and, therefore, the printing head, to be positioned without difficulty.

The parallel guide can be implemented in various ways. Thus, for example, one or more corresponding guide rails or the like may be provided for the guide device, which impart a straightforward translational movement to the latter during offsetting.

A particularly simple and robust refinement that is less susceptible to faults is obtained when the offsetting device includes a planar four-membered articulated mechanism that ensures guidance during the offsetting of the guide device. Such an articulated mechanism manages with simple rotary or pivot joints while ensuring a high degree of movement accuracy. As a result, in particular, incorrect angular positions of the guide device in the respective transverse positions are counteracted. Correspondingly, incorrect angular positions of the printing images in relation to one another are also counteracted. In particular, a parallel guide can be implemented in a simple way by using such an articulated mechanism.

The guide device may be connected indirectly or directly to the offsetting device in any desired way. It may, for example, be fastened directly to that member of the articulated mechanism that itself executes the desired offsetting movement. In the case of variants of the apparatus according to the invention that are advantageous because they have a simple construction, the first guide device itself forms a member of the articulated mechanism. For such a purpose, it may, for example, be directly connected at both ends to two further members belonging to the articulated mechanism.

The offsetting device can be constructed in various ways in terms of its drive for offsetting the guide device. Thus, for example, one or more separate driving devices that bring about the offsetting movement may be provided. In accordance with a further feature of the invention, the offsetting device is constructed for offsetting the first guide device by a movement of the printing head in the given direction. Thus, it is unnecessary to have a separate drive for the offsetting device. Instead, the drive for moving the printing head is also utilized for operating the offsetting device.

To achieve the offsetting movement of the guide device by movement of the printing head in the given direction, a multiplicity of refinements may be envisaged. Thus, for example, a second guide device may be provided, which is disposed on the printing head or its mounting and cooperates with a third guide device to achieve the offsetting movement. The third guide device is disposed fixedly in or on the apparatus such that, during the movement of the printing head in the given direction, a relative movement occurs between the second and the third guide device. The active surfaces of the second and third guide devices are then disposed such that, during the movement of the second and third guide devices in the given direction relative to one another, a force component occurs transverse to the given direction and is imparted by the second guide device to the printing head and through the latter to the first guide device. The force component transverse to the given direction then brings about the offsetting of the first guide device.

In the variant mentioned, a compensating device is provided that compensates the offset between the drive and the printing head during the offsetting of the first guide device. Additionally or alternatively, the entire drive may be offset correspondingly together with the guide device.

In preferred variants of the apparatus according to the invention, a driving device for moving the printing head in the given direction is provided, which is itself constructed such that it offsets the first guide device by movement of the printing head in the given direction. Offsetting of the driving device or a corresponding compensating device thereby becomes unnecessary.

Preferably, at the same time, the driving device is constructed as a traction drive with at least one traction device running through at least one first deflecting device. The printing head is then connected, in a first connection region, to the traction device such that when the first connection region runs over the first deflecting device, the first guide device is offset transverse to the given direction by being taken up through the printing head.

The connection between the traction device, for example, a toothed belt, and the printing head may be made, for example, through a connecting device, such as a connecting pin. The pin is disposed rotationally movable on the printing head or the traction device, or on both. When the first connection region runs over the first deflecting device, the connecting pin is moved transverse to the given direction in a way predetermined by the deflecting device. The connecting pin then acts as a take-up device by imparting its movement transverse to the given direction to the printing head and, therefore, also to the first guide device connected to the latter.

The first deflecting device, the further guide of the traction device and the connection between the traction device and the printing head or the printing-head mounting are preferably constructed such that the offset of the connecting device corresponds to the desired transverse offset of the printing head. As a result, the desired offset transverse to the given direction is imparted to the printing head in a simple way without further additional measures.

The deflecting device may be formed of one or more guide tracks, deflecting rollers, or the like. Preferably, the first deflecting device is constructed as a deflecting roller. The axis of rotation of the deflecting roller runs essentially perpendicular to the offset plane of the first guide device. At the same time, the offset of the guide device and, therefore, also the printing head then corresponds in a simple way to the offset that the connecting device undergoes between the printing head and traction device.

Preferably, the first deflecting device is disposed in a region of the first longitudinal position of the printing head to achieve thereby as small a construction space at the apparatus as possible in the given direction.

The driving device may be constructed as an open traction drive that is operated with an alternating driving direction, in order to return to the initial position again after one or two complete prints. In advantageous variants, the driving device is constructed as a closed traction drive because it has a simple makeup. As such, the second deflecting device for offsetting the guide device transverse to the given direction is provided, which causes the guide device to be offset back into the initial position. The traction drive can then be driven both in one direction and alternately in both directions. In accordance with an added feature of the invention, the second deflecting device is disposed in a region of the second longitudinal position of the printing head.

It goes without saying that the traction device may also be guided through further deflecting devices when, for example, the complete print is to be composed of more than two printing images disposed next to one another transverse to the given direction.

With a view to as small a construction space of the apparatus as possible in the given direction, the second deflecting device is preferably disposed in the region of the second longitudinal position of the printing head.

To ensure that the guide device and, therefore, the printing images generated using the printing head are reliably aligned with one another, in advantageous variants of the apparatus according to the invention a fixing device is provided for fixing the guide device in the respective transverse position.

In beneficial refinements, the fixing device includes in each case at least one stop for the guide device in the respective transverse position and at least one prestressing device for prestressing the guide device against the respective stop. The prestressing device may be constructed such that it is prestressed by a prestressing device, for example, a spring or the like, against the first guide device located in one of the desired transverse positions. Thereby, a change in position of the first guide device is prevented.

The prestressing device may still be constructed such that the force exerted by the offsetting device onto the first guide device during offsetting, which, between the desired transverse positions, is sufficient to remove the prestressing device from the path of movement of the first guide device counter to the prestressing force of the prestressing device. In other words, the prestressing device may be constructed such that, during the desired offsetting operations, it is forced out of the way of the first guide device by the latter.

With the objects of the invention in view, there is also provided, a method for printing, in particular, a method for making a franking impression, including the steps of guiding, with a guide device, a printing head to print a first printing image between a first longitudinal position and a second longitudinal position in a given direction and to print at least one second printing image offset to the first printing image in a direction transverse to the given direction and overlapping the first printing image at most in an edge region of the first printing image, and offsetting the printing head from a first transverse position into at least one second transverse position spaced from the first transverse position in a direction transverse to the given direction by offsetting the guide device transverse to the given direction.

The invention relates, furthermore, to a method for printing, in particular, a franking impression, in which a printing head for printing a first printing image is moved, guided by a first guide device, in a given direction between a first longitudinal position and a second longitudinal position. To print at least one second printing image offset to the first printing image transverse to the given direction and overlapping with the first printing image at most in an edge region, the printing head is offset from a first transverse position into at least one second transverse position spaced from the first transverse position transverse to the given direction. According to the invention, at the same time, the first guide device is offset transverse to the given direction for offsetting the printing head transverse to the given direction.

In accordance with an additional mode of the invention, offsetting takes place in one plane, because it results in the desired end position being reached quickly. Additionally, the movement space to be kept free for such a movement can be kept small for such a movement profile. Thus, a small construction space for an apparatus operating under the method results. Various points in time at which the offsetting of the first guide device can take place may be envisaged. Thus, the offsetting of the first guide device may take place after the movement of the printing head between the first and second longitudinal positions and the return into the first longitudinal position. A particularly simple and, therefore, rapid movement sequence or a rapid printing operation occurs preferably when the offsetting of the first guide device takes place after, preferably, immediately after, the movement of the printing head between the first and second longitudinal positions. The features are all the more so when, in further preferred variants, the offsetting-back of the first guide device takes place after, preferably, immediately after, the movement of the printing head between the second and first longitudinal positions.

Advantageously, the offsetting of the first guide device takes place as result of the movement of the printing head in the given direction. Therefore, a further drive for offsetting becomes unnecessary.

In accordance with yet another mode of the invention, the guide device is offset by a movement of the printing head in the given direction.

In accordance with a concomitant mode of the invention, at least two printing images are printed offset to one another transverse to the given direction by driving the printing head with a closed traction drive in one direction, connecting at least two deflecting devices of a traction device to the printing head through a connection, and offsetting the guide device, carried by the printing head, transverse to the given direction when a connection region of the printing head and the traction device passes one of the at least two deflecting devices.

Other features that are considered as characteristic for the invention are set forth in the appended claims.

Although the invention is illustrated and described herein as embodied in a printing apparatus and a printing method with a movable printing-head guide, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
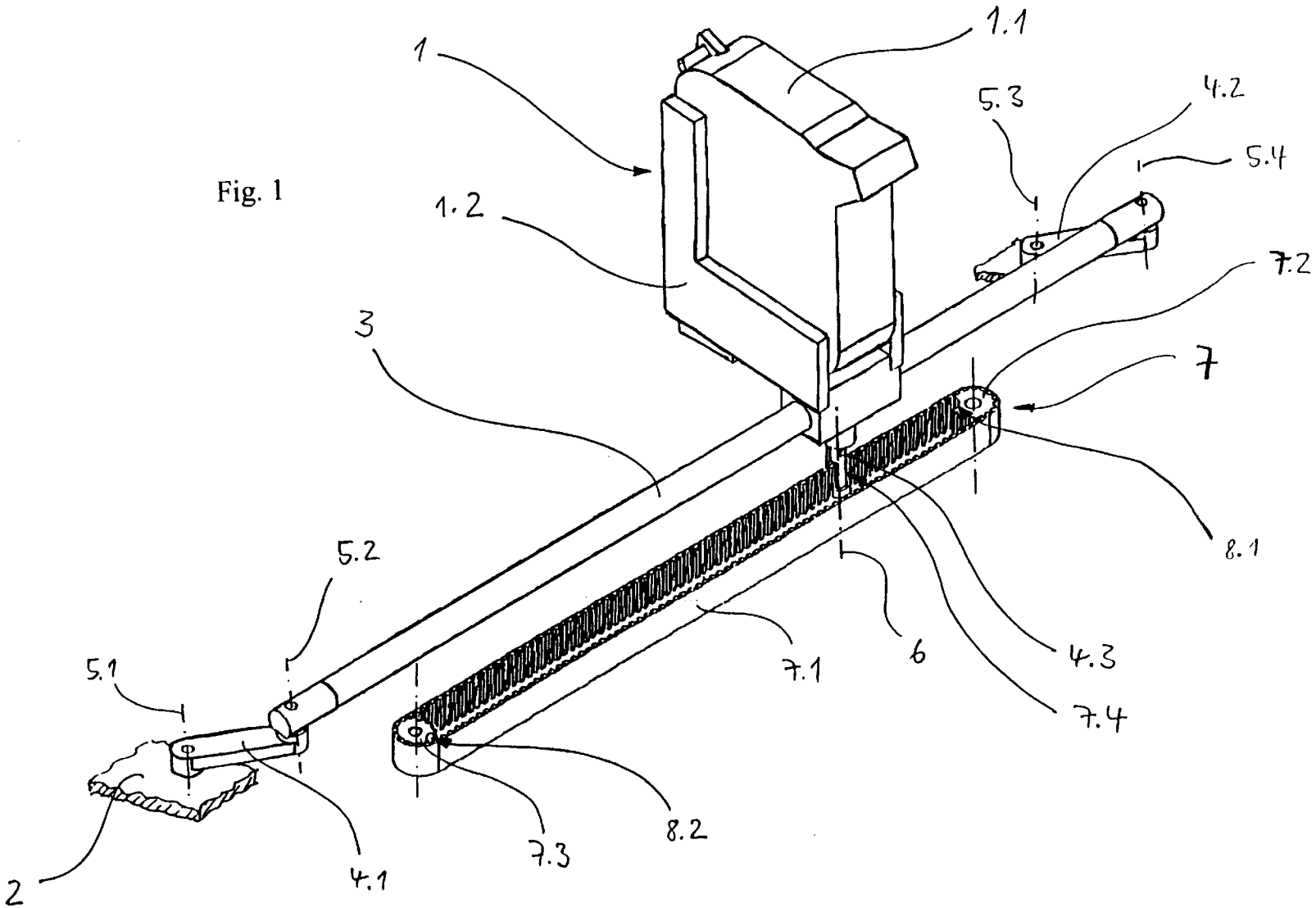
FIG. 1 is a fragmentary, diagrammatic, perspective view of a preferred exemplary embodiment of the apparatus according to the invention.

Referring now to the figures of the drawings in detail and first, particularly, to FIG. 1 thereof, there is seen a fragmentary view of a franking machine with a printing head 1 which, in the illustrated example, is formed by an ink-jet cartridge 1.1 fastened exchangeably in a mounting 1.2.

Figure 2:
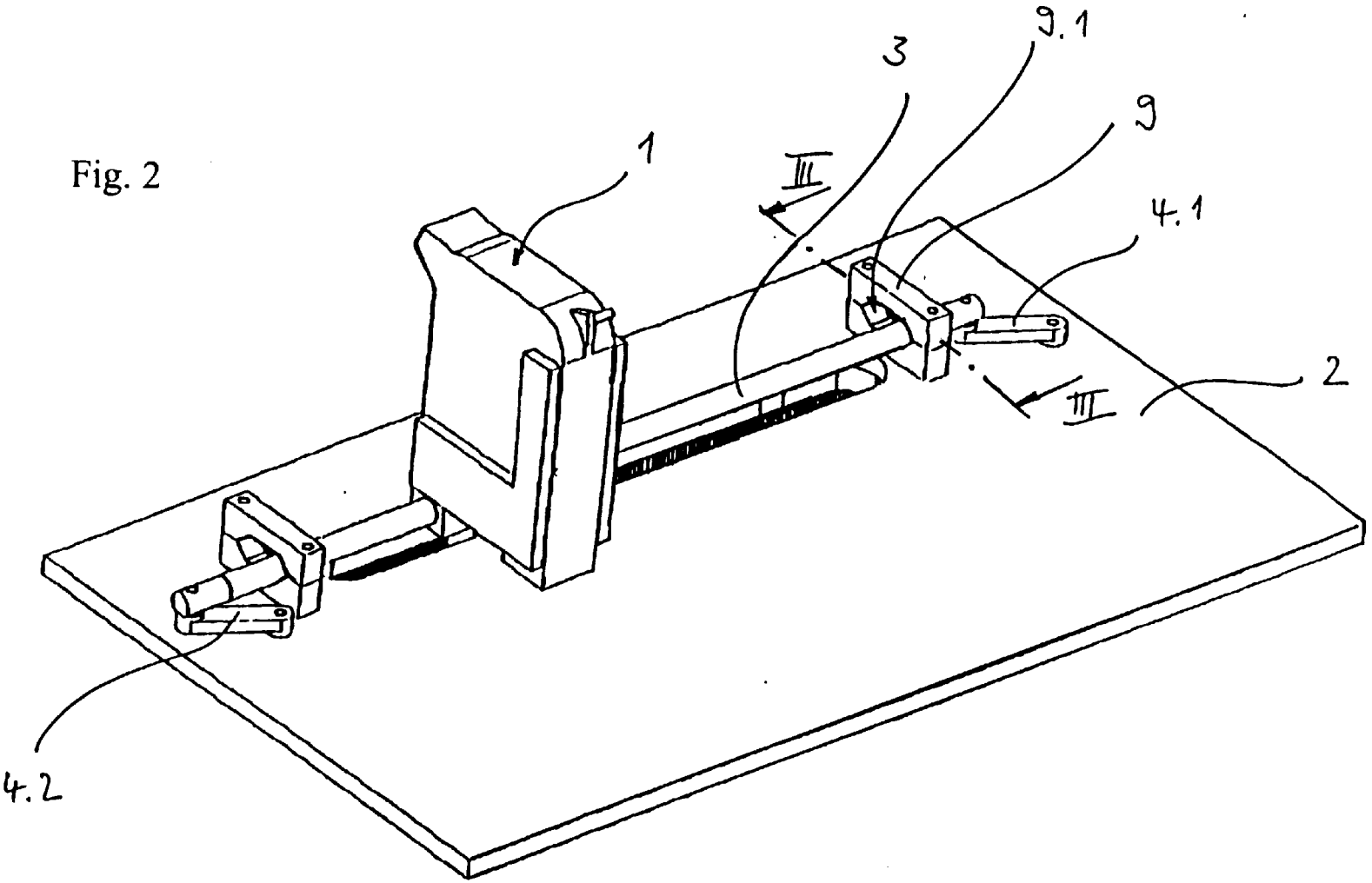
FIG. 2 is a further perspective view of the exemplary embodiment of FIG. 1.
Figure 5:
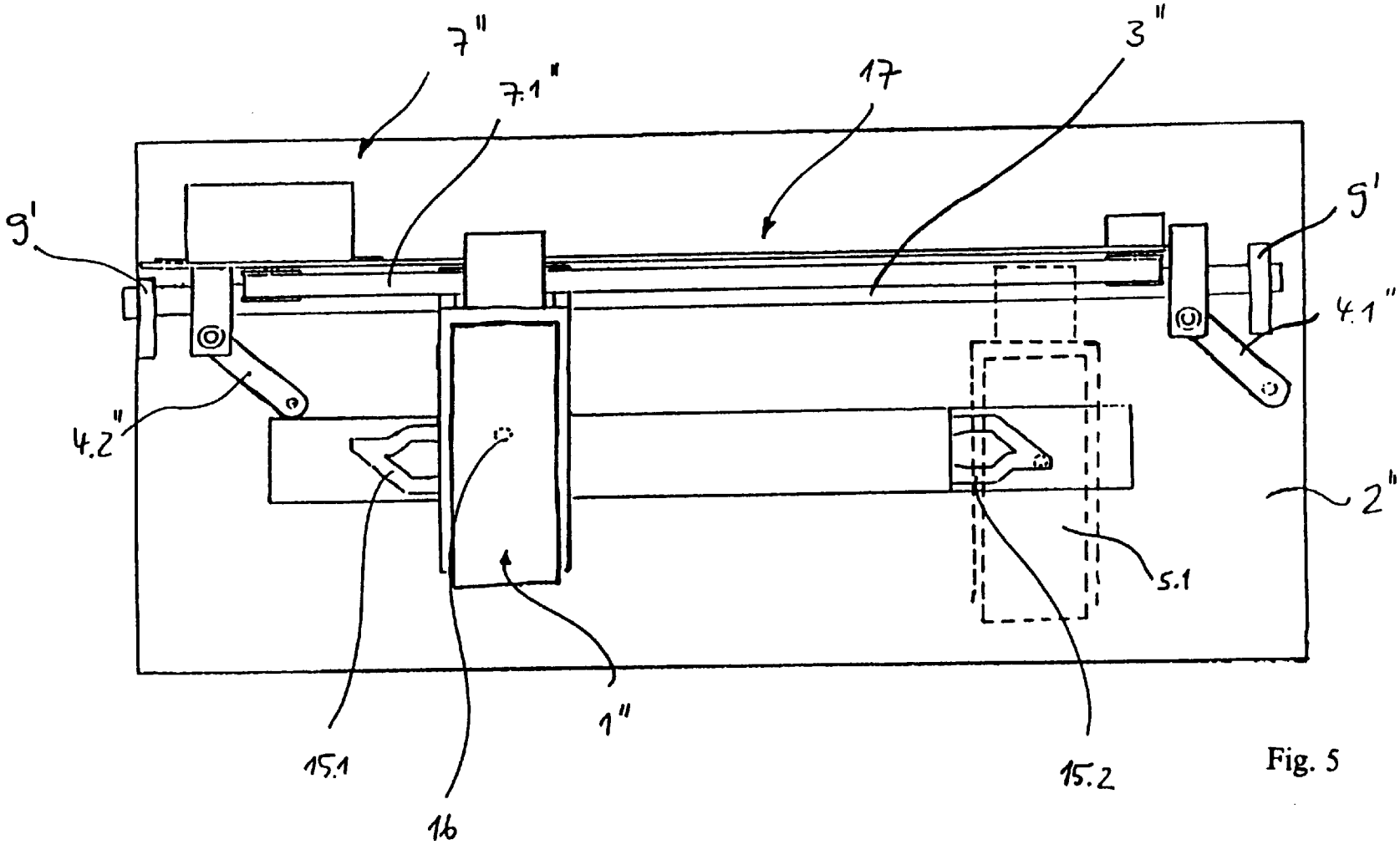
FIG. 5 is a top-plan view of another preferred exemplary embodiment of the apparatus according to the invention.

In order to achieve the relative movement between the printing head 1 and the non-illustrated medium to be printed, the printing head 1 is capable, during printing, of being moved between a first longitudinal position and a second longitudinal position (as indicated in FIG. 5 by contour 5.1) in a given direction with respect to a base element 2 (see FIG. 2). The printing head is at the same time guided in the given direction 20 by a first guide device, which is formed as a guide rod 3.

Also provided is an offsetting device that allows the printing of printing images offset to one another transverse to the given direction 20 and overlapping one another at most in an edge region. The offsetting device is constructed for offsetting the printing head 1 relative to the base element 2 from a first transverse position into at least one second transverse position spaced from the first transverse position transverse to the given direction as indicated in FIG. 5 by contour 5.1.

The offsetting device may include, inter alia, a first pivoting arm 4.1 and a second pivoting arm 4.2. The pivoting arms 4.1, 4.2 are respectively pivotably connected at one end to the base element 2 and at the other end to the guide rod 3 about respective axes 5.1, 5.2, 5.3, 5.4 running perpendicular to the given direction 20. The pivot axes 5.1, 5.2 of the first pivoting arm 4.1 have the same spacing as the pivot axes 5.3, 5.4 of the second pivoting arm 4.2. Furthermore, the spacing of the pivot axes 5.1, 5.3 corresponds to the spacing of the pivot axes 5.2, 5.4. The pivoting arms 4.1, 4.2 thereby form, together with the base element 2 and the guide rod 3, a planar, four-membered, articulated mechanism.

The articulated mechanism guides the guide rod 3 during the pivoting of the pivoting arms 4.1, 4.2. The mechanism simultaneously brings about a parallel offset of the guide rod 3 and an offset of the printing head 1 transverse to the given direction, i.e., transverse to the printing direction. The offsetting movement takes place in one plane through the mutually parallel pivot axes 5.1, 5.2, 5.3, 5.4. Such movement results in a low-projection offsetting movement of the guide rod 3 and, therefore, also of the printing head 1. An advantage of the configuration is that only as small a proportion of the surrounding construction space as possible needs to be kept free for the offsetting movement.

The drive 7 for moving the printing head 1 in the given direction 20 is constructed as a simple traction drive with a closed toothed belt 7.1 that runs over two corresponding gearwheels 7.2, 7.3 of the same diameter. The gearwheels 7.2, 7.3 serve as first and second deflecting devices. The gearwheels 7.2, 7.3 are mounted on the base element 2, which is not illustrated in FIG. 1 for the sake of clarity. The rotation axes of the gearwheels 7.2, 7.3 run perpendicular to the offsetting plane of the guide rod 3. At the same time, a non-illustrated motor drives the first gearwheel 7.2.

The offsetting device and the drive 7 are constructed for offsetting the guide rod 3 and, therefore, the printing head 1 transverse to the given direction by a movement of the printing head 1 in the given direction. The offsetting device includes a pin 4.3 that is disposed on the printing head 1 rotatably about an axis of rotation 6. The pin 4.3 is connected in a first connection region 7.4 to the toothed belt 7.1 of the drive 7. The gearwheels 7.2, 7.3 each have a respective indentation 8.1, 8.2. The indentations 8.1, 8.2 receive that portion of the pin 4.3 that is disposed on the toothed side of the toothed belt 7.1, when the connection region 7.4 runs over the respective gearwheel 7.2, 7.3.

When the connection region 7.4 runs over the respective gearwheel 7.2, 7.3, the pin 4.3, rotating about its axis 6, is offset relative to the printing head 1 transverse to the given direction. The pin 4.3 acts as a take-up device on the printing head 1 and offsets the printing head 1 and also the guide rod 3 transverse to the given direction. The offset approximately corresponds to double the spacing between the axis of rotation 6 and the axis of rotation of the respective gearwheel 7.2, 7.3 when the connection region 7.4 runs over the respective gearwheel 7.2, 7.3. The spacing is selected such that the offset of the printing head 1 transverse to the given direction corresponds approximate to the dimension of the printing images, generated by the printing head, transverse to the given direction.

When the connection region 7.4 runs over the first gearwheel 7.2, the printing head 1, after executing a first printing image, is offset from its first transverse position into its second transverse position. The printing head 1 is subsequently moved between the first gearwheel 7.2 and the second gearwheel 7.3, a second printing image adjacent to the first printing image transverse to the given direction being generated using the printing head 1. As result of the parallel offset of the guide rod 3, the second printing image is parallel to the first printing image and completes the first printing image to form an entire printing image. When the connection region 7.4 runs over the second gearwheel 7.3, the printing head is then offset from its second transverse position back into its first transverse position again, resulting in the conclusion of the printing operation.

The first gearwheel 7.2 forming the first deflecting device of the toothed belt 7.1 is disposed in the region of the first longitudinal position of the printing head 1, so that the transverse offset of the printing head 1 can take place immediately after the execution of a first printing image. The second gearwheel 7.3 forming the second deflecting device of the toothed belt 7.1 is disposed in a region of the second longitudinal position of the printing head 1, so that the transverse offset of the printing head 1 into its initial position can take place immediately after the execution of a second printing image. However, it goes without saying herein that even a certain spacing between the second gearwheel and the second longitudinal position of the printing head 1 may be provided to enable placing the printing head in a maintenance or parking station in the region.

FIG. 2 shows a further perspective view of the embodiment of FIG. 1. As may be gathered from FIG. 2, the guide rod 3 runs in a perforation 9.1 of a guide element 9 in a region at each of its two ends. The guide element 9 serves for additionally supporting the guide rod 3 perpendicular to the transverse offset plane.

Figure 3:
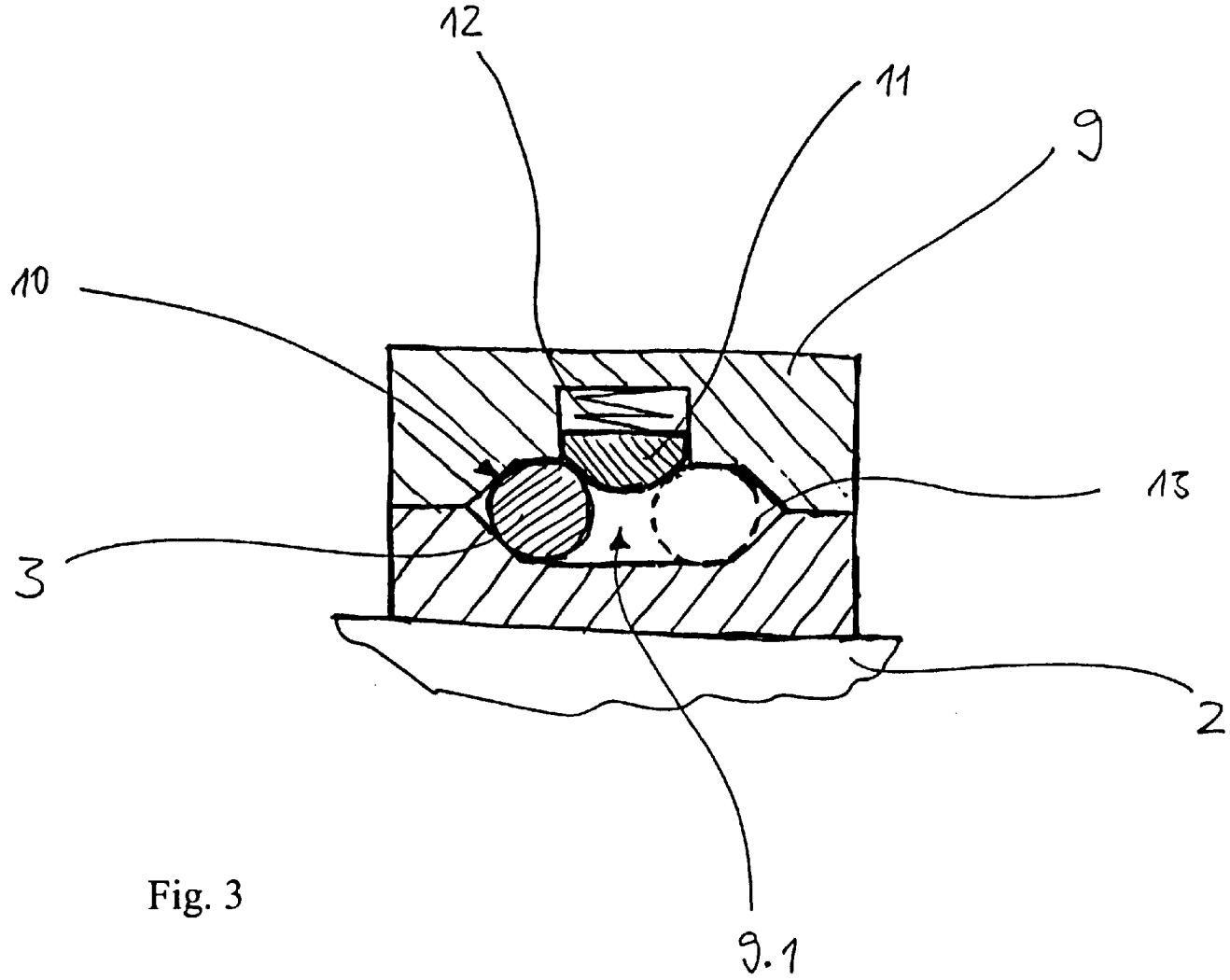
FIG. 3 is an enlarged, fragmentary, sectional view taken along a line III—III of FIG. 2, in the direction of the arrows.

As may be gathered from FIG. 3, the guide element 9 forms a fixing device for fixing the guide rod 3 in the respective transverse position. Stops 10 for the guide rod 3 are provided that limit the offset of the guide rod 3 transverse to the given direction in the respective transverse position. Furthermore, mounted displaceably in the guide element 9 is a locking disk 11 that is prestressed against the guide rod 3 by a spring 12. The guide rod 3 is, thereby, pressed against the stops 10 in the respective transverse position and is, thus, fixed in the position.

When the guide rod 3 is being offset into the other transverse position, indicated in FIG. 3 by the contour 13, the locking disk 11 is displaced by the guide rod 3 out of the locking disk 11 movement path. After the guide rod 3 has passed the locking disk 11, the locking disk 11 moves again, by virtue of the spring force of the spring 12, into its blocking position in the guide rod 3 is fixed in the other transverse position.

Figure 4:
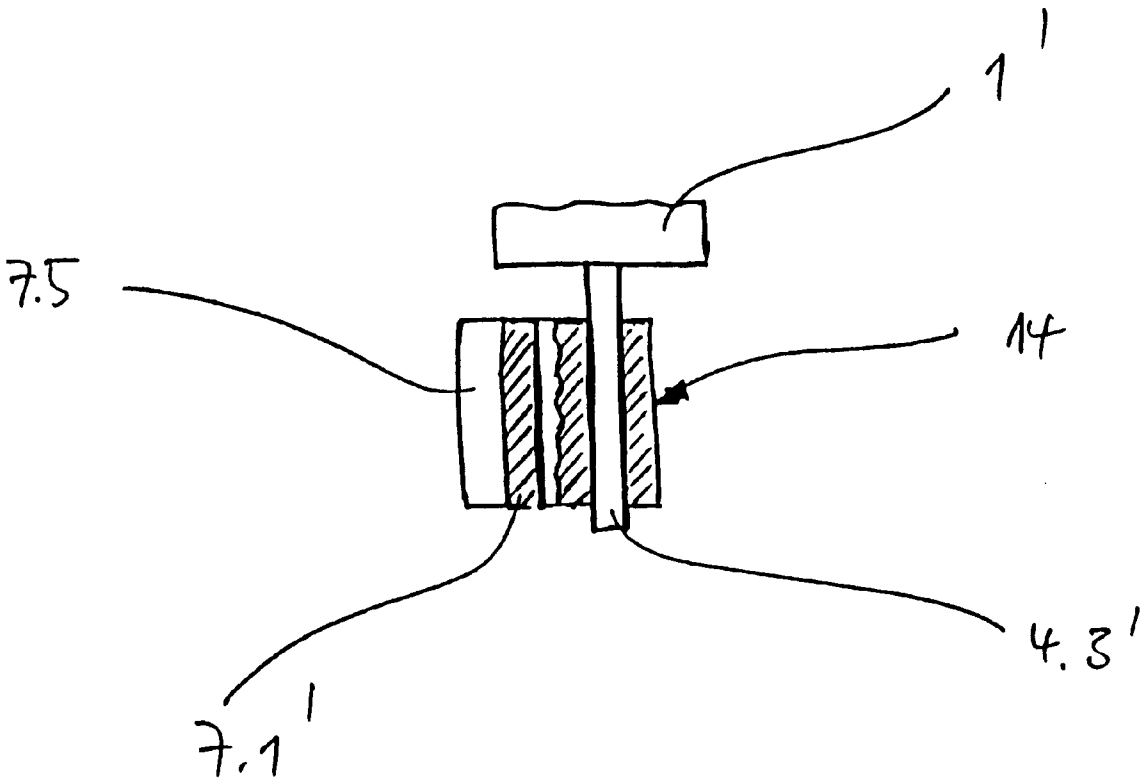
FIG. 4 is a fragmentary, sectional view of a further preferred exemplary embodiment of the apparatus according to the invention.

FIG. 4 shows, in detail, a variant of the connection of the pin 4.3' connected to the printing head 1' to the traction device 7.1' of the drive for moving the printing head 1' in the given direction. The connection is made using a strap 14 that is disposed on the toothed belt 7.1' on a side of the toothed belt 7.1' that faces away from the teeth 7.5. The pin 4.3' is mounted rotatably in the strap 14. However, it goes without saying that the pin may additionally or alternatively also be disposed rotatably on the printing head 1'.

It goes without saying that other variants of the apparatus may also be constructed for generating more than two printing images adjacent to one another. It is then necessary merely to provide more than two deflecting devices for the traction device that then impart an S-shaped run to the latter in portions.

FIG. 5 shows a top view of another version of the apparatus according to the invention, corresponding largely to the apparatus shown in FIG. 1. Thus, only the differences are discussed.

The essential difference is the generation of the transverse offset, which is generated by a movement of the printing head 1" in the given direction. In the embodiment of FIG. 5, however, the transverse offset is generated by two guide grooves 15.1, 15.2 that are disposed on the base element 2" and, for offsetting the guide device, cooperate with a guide pin 16 disposed on the underside of the printing head 11".

In the version shown, as in the version from FIG. 2, fixing devices 9' are provided to hold the guide rod 3' in the respective transverse position. The guide grooves 15.1, 15.2 are constructed such that the locking disk 11 has already been passed by the guide rod 3 at the point in time of the reversal of movement of the printing-head drive. The locking disk 11, therefore, exerts on the guide rod 3 a prestressing force that presses the guide rod 3 into the desired offset direction.

However, it goes without saying that variants may also be envisaged, in which the guide rod is prestressed into a direction transverse to the given direction by a spring device. As such, in the region of the guide groove that offsets the guide rod counter to the prestress, a correspondingly prestressed deflector must be provided, which, after the reversal of movement, prevents the guide pin from moving again into the guide groove leg already passed. For such a purpose, in the normal state, the deflector closes the groove leg first to be passed. During movement of the printing-head mounting, the guide pin displaces the deflector out of the leg of the groove and can, thus, pass the latter. The deflector subsequently snaps back and prevents the guide pin from moving again into the leg already passed, after the reversal of movement.

Another difference is the configuration of the drive 7" for moving the printing head in the given direction. The drive 7" is constructed, once again, as a toothed-belt drive with a closed tooth belt 7.1". However, the drive 7" is disposed on a carrier 17 that is connected firmly to the guide rod 3", and, together with the guide rod 3", is offset transverse to the given direction in a guided manner by the planar four-membered articulated mechanism being formed of the guide rod 3", the pivoting arms 4.1", 4.2", and the base element 2".

In the example shown, the guide grooves 15.1, 15.2 each extend only over a limited region. They are disposed in the region of the first and second longitudinal positions of the printing head 1. However, it goes without saying that they may also be formed by a continuous guide groove forming a closed guide track for the guide pin.

The invention is not restricted to the exemplary embodiments presented above. On the contrary, a number of variants may be envisaged, which also implement the invention in a version differing from what was described above.

We claim:

1. An apparatus for printing, comprising:

a base element;

a guide device moveably connected to said base element;

a printing head connected to said guide device and guided by said guide device during printing, between a first longitudinal position and a second longitudinal position in a given direction with respect to said base element to effect a relative movement between said printing head and a medium to be printed;

a driving device connected to said painting head for moving said printing head in said given direction, said driving device being a traction drive having at least one first deflecting device said printing head being connected to said traction drive at a connection region, said connection region traveling over said at least one first deflecting device as said printing head moves in said given direction, causing said guide device and said printing head to be offset transversely with respect to said given direction; and an offsetting device allowing said guide device to be offset transversely with respect to said given direction for printing first and second images being offset to one another.

2. The apparatus according to claim 1, wherein said offsetting device offsets said guide device essentially in one plane.

3. The apparatus according to claim 1, wherein said offsetting device offsets said guide device in substantially mutually parallel positions.

4. The apparatus according to claim 1, wherein said offsetting device includes a planar, four-membered, articulated mechanism for guiding said guide device during offsetting.

5. The apparatus according to claim 4, wherein said guide device is a member of said articulated mechanism.

6. The apparatus according to claim 1, wherein said at least one first deflecting device is a deflecting roller having an axis of rotation running essentially perpendicular to an offset plane of said guide device.

7. The apparatus according to claim 1, wherein said at least one first deflecting device is disposed in a region of said first longitudinal position of said printing head.

8. The apparatus according to claim 1, wherein said driving device is a closed traction drive, and said driving device has a second deflecting device for offsetting said guide device transverse to said given direction.

9. The apparatus according to claim 8, wherein said second deflecting device is disposed in a region of said second longitudinal position of said printing head.

10. The apparatus according to claim 1, including a fixing device for fixing said guide device in a respective one of said first transverse position and said at least one second transverse position.

11. The apparatus according to claim 10, wherein said fixing device has at least one stop for said guide device at each of said first transverse position and said at least one second transverse position, and including at least one prestressing device for prestressing said guide device against said at least one stop.

12. A franking machine, comprising:

a base element;

a guide device moveably connected to said base element;

a printing head connected to said guide device and guided by said guide device during printing, between a first longitudinal position and a second longitudinal position in a given direction with respect to said base element to effect a relative movement between said printing head and a medium to be printed;

a driving device connected to said printing head for moving said printing head in said given direction, said driving device being a traction drive having at least one first deflecting device, said printing head being connected to said traction drive at a connection region, said connection region traveling over said at least one first deflecting device as said printing head moves in said given direction, causing said guide device and said printing head to be offset transversely with respect to said given direction; and an offsetting device allowing said guide device to be offset transversely with respect to said given direction for printing first and second images being offset to one another.

13. A method for printing, which comprises:

providing a base element;

providing a guide device movably connected to the base element;

providing a printing head connected to the guide device and guided by the guide device during printing, between a first longitudinal position and a second longitudinal position in a given direction with respect to the base element to effect a relative movement between the printing head and a medium to be printed for printing a first printing image between the first longitudinal position and the second longitudinal position in the given direction and to print at least one second printing image offset to the first printing image in a direction transverse to the given direction and overlapping the first printing image at most in an edge region of the first printing image;

moving the printing head in the given direction with a driving device, the driving device being a traction drive having at least one first deflecting device, the printing head being connected to the traction drive at a connection region; and offsetting the guide device and the printing head, by moving the printing head in the given direction causing the connection region to travel over the at least one first deflecting device.

14. The method according to claim 13, which further comprises offsetting the guide device essentially in one plane.

15. The method according to claim 13, which further comprises offsetting the guide device after a movement of the printing head between the first and second longitudinal positions.

16. The method according to claim 14, which further comprises offsetting the guide device after a movement of the printing head between the first and second longitudinal positions.

17. The method according to claim 15, which further comprises offsetting back the guide device after a movement of the printing head between the second and first longitudinal positions.

18. The method according to claim 16, which further comprises offsetting back the guide device after a movement of the printing head between the second and first longitudinal positions.

19. The method according to claim 13, which further comprises printing at least two printing images offset to one another transverse to the given direction by:

driving the printing head with a closed traction drive in one direction;

selectably connecting at least two deflecting devices of an offsetting device to the printing head through a connection; and offsetting the guide device, carried by the printing head, transverse to the given direction when the connection passes one of the at least two deflecting devices.

20. A method for making a franking impression, which comprises:

providing a base element;

providing a guide device movably connected to the base element;

providing a printing head connected to the guide device and guided by the guide device during printing, between a first longitudinal position and a second longitudinal position in a given direction with respect to the base element to effect a relative movement between the printing head and a medium to be printed for printing a first printing image between the first longitudinal position and the second longitudinal position in the given direction and to print at least one second printing image offset to the first printing image in a direction transverse to the given direction and overlapping the first printing image at most in an edge region of the first printing image;

moving the printing head in the given direction with a driving device, the driving device being a traction drive having at least one first deflecting device, the printing head being connected to the traction drive at a connection region; and offsetting the guide device and the printing head, by moving the printing head in the given direction causing the connection region to travel over the at least one first deflecting device.

* * * * *